United States Patent [19]

Nakao

[11] 4,019,276

[45] Apr. 26, 1977

[54] AUTOMOBILE TOY

[75] Inventor: Shinroku Nakao, Yokohama, Japan

[73] Assignee: Combi Co., Ltd., Tokyo, Japan

[22] Filed: July 1, 1975

[21] Appl. No.: 592,163

[30] Foreign Application Priority Data

July 4, 1974 Japan ..... 49-78923[U]
July 5, 1974 Japan ..... 49-79602[U]

[52] U.S. Cl. ..... 46/99; 46/202
[51] Int. Cl.[2] ..... A63H 17/25
[58] Field of Search ..... 46/98, 99, 202, 106, 46/107

[56] References Cited

UNITED STATES PATENTS

| | | | |
|---|---|---|---|
| 1,722,340 | 7/1929 | Richter | 46/107 |
| 2,480,996 | 9/1949 | Bocchino | 46/99 |
| 2,494,681 | 1/1950 | Wisoff | 46/98 |
| 2,641,863 | 6/1953 | Gowland | 46/99 |
| 3,238,665 | 3/1966 | Doe | 46/107 |
| 3,748,780 | 7/1973 | Glass et al. | 46/202 |

*Primary Examiner*—Hugh R. Chamblee
*Assistant Examiner*—Robert F. Cutting

[57] ABSTRACT

An automobile toy adapted to be moved by pulling a tow string by an infant in which when the automobile toy is moved along a support floor or ground by pulling the tow string, the body of the automobile toy moves upwardly and downwardly and at the same time, the driver figure doll loosely received in the body moves back and forth. The automobile toy further includes a sound producing mechanism which is operated to produce a sound when the front wheels of the automobile toy rotate and a front cover pivotally mounted in the front portion of the automobile toy body so as to uncover the internal structure within the front portion of the body when the front cover is pivoted to its open position.

7 Claims, 13 Drawing Figures

AUTOMOBILE TOY

BACKGROUND OF THE INVENTION

This invention relates to an automobile toy adapted to be moved by means of a tow string.

There have been proposed a great variety of automobile toys which are adapted to be moved by means of a tow string and produce a sound when the toy is moved.

However, most of the prior art automobile toys of the type described above have a relatively complicate construction and lack in reality.

SUMMARY OF THE INVENTION

Therefore, one principal object of the present invention is to provide a novel and improved automobile toy which is adapted to be moved by a tow string and produce a sound when the toy is moved and which has a relatively simple construction.

Another object of the present invention is to provide an automobile toy which has a body adapted to move upwardly and downwardly as the automobile toy moves, a driver figure doll loosely received in the body and adapted to move back and forth as the body moves upwardly and downwardly and a sound producing mechanism adapted to intermittently produce a sound as said body moves upwardly and downwardly.

A further object of the present invention is to provide an automobile toy which has a front cover pivotally mounted in the front portion of the body so as to uncover a simulated engine formed within the front portion of the body when the cover is pivoted to its open position and doors are pivotally mounted in the driver's chamber of the body to thereby give a more reality to the automobile toy.

According to the present invention, there has been provided an automatic toy which comprises in combination a body having an open front portion, a rear portion and a driver's compartment positioned between said front and rear portions, a front cover pivotally mounted in said front body portion and normally closing the front portion said cover being movable between the closing and open positions, a transverse front wheel axle extending across said front body portion and coaxially supporting front wheels at the extreme opposite ends, A rear wheel axle extending across said rear body portion and eccentrically supporting rear wheels at the extreme opposite ends, a driver figure doll loosely received in said driver's compartment for rocking movement back and forth as said rear wheels rotate eccentrically, doors pivoted on the opposite sides of said driver's compartemnt, a simulated engine formed within said front portion of the body to be uncovered when said front cover is pivoted to its open position and a sound producing mechanism.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

BRIEF DESCRIPTION OF THE DRAWINGS

The accompanying drawings show one preferred embodiment of automobile toy constructed in accordance with the present invention and in which.

PREFERRED EMBODIMENT OF THE INVENTION

Figure 1:
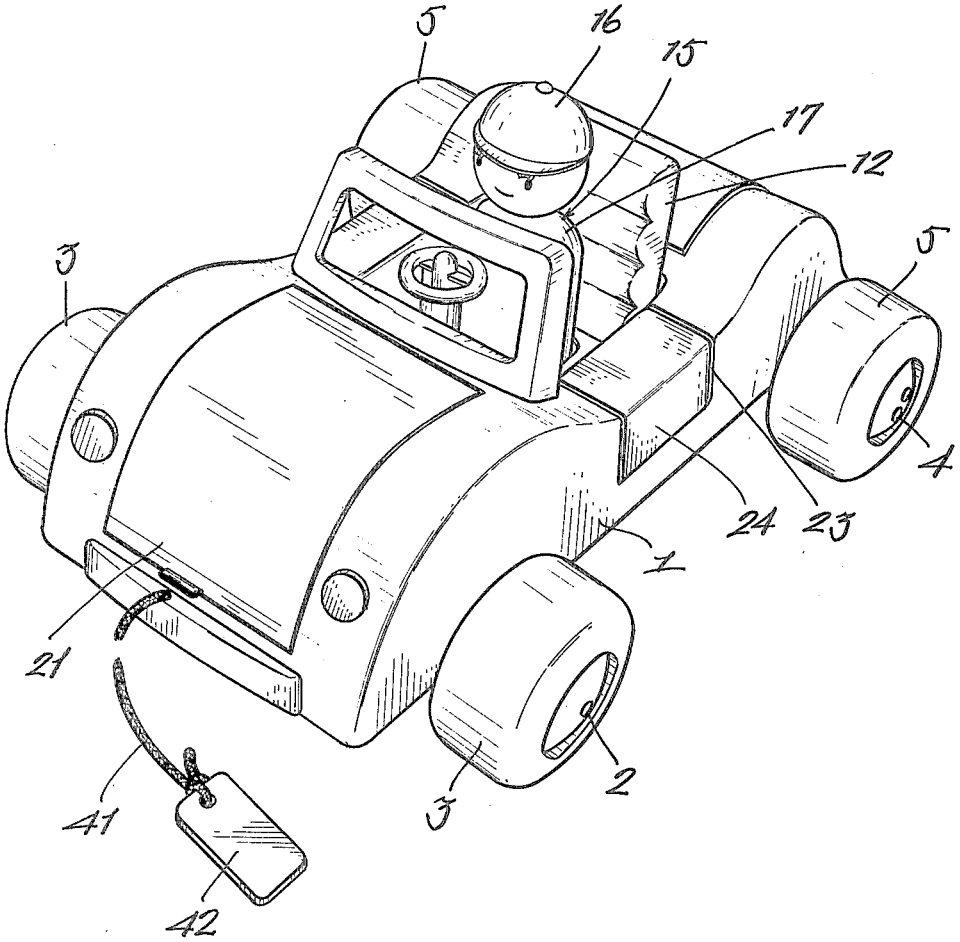
FIG. 1 is a perspective view of said automobile toy.

The present invention will be now described referring to the accompanying drawings which show one preferred embodiment of automobile toy embodying the present invention for illustration purpose only, but not for limiting the scope of the same in any way. The automobile toy of the invention generally comprises the body which is generally shown by reference numeral 1 formed of any suitable synthetic resin and the body supports a transverse front wheel axle 2 at the extreme opposite ends of which front wheels 3, 3 are coaxially mounted and a transverse rear wheel axle 4 at the extreme opposite ends of which rear wheels 5, 5 are eccentrically mounted. Since the rear wheels 5, 5 are eccentrically mounted on the rear wheel axle 4, as the automobile toy is moved along a support floor or ground, the body 1 moves upwardly and downwardly in the rer portion thereof. The mounting arrangement of the front and rear wheels will be in detail described hereinafter.

The driver's compartment 6 in the body 1 is formed in the center of the bottom thereof with a recess and a pair of spaced upright members 7, 7 extend upwardly from the recess adjacent to the opposite sides thereof so as to define guide grooves 8, 8 in cooperation with the opposite side walls which define the recess. A pair of spaced slots 9, 9 are formed in each of the grooves 8, 8 for the purpose to be described hereinafter. The driver figure doll's seat member is generally shown by reference numeral 10 and has a substantially L-shape.

The seat member 10 includes a substantially horizontal seat portion 11 and an integral substantially upright back rest portion 12. The seat portion 11 has a center circular opening 13 for loosely receiving a driver figure doll of which description will be made hereinafter.

The seat portion 11 has a pair of downwardly extending projections 14, 14 adjacent to each of the opposite sides of the bottom thereof to be received in the mating slots 9, 9 in the recess in the driver's compartment 6 so as to hold the seat member 10 in position. The driver figure doll 15 had a head portion 16, a body trunk 17 which has a diameter substantially smaller than that of the opening 13 in the seat portion 11 and a base portion 18 which has the arcuate bottom surface 18*a*. The head portion 16, body trunk 17 and base portion 18 are integral with each other and the base portion 18 has dimensions greater than the diameter of the opening 13 so as to prevent the driver figure doll 15 from coming off the opening 13 once the doll is received in the opening 13. Therefore, when the body 1 moves upwardly and downwardly as the rear wheels 5, 5 rotate eccentrically as mentioned hereinabove, the driver figure doll 15 rocks back and forth within the opening 13 in the seat portion 11.

The front portion of the body 1 is formed in the center portion with an opening 19 in which a simulated engine 20 is formed and the opening 19 is normally closed by a pivotal cover 21 which has a pair of pivot pins (not shown) projecting outwardly from the opposite sides at one or the rear edge of the cover and loosely received in the mating slots (not shown) in the side walls which define the opening 19 in the body front portion.

Thus, when the cover 21 is pivoted from the closed position to the open position to uncover the simulated engine 20, an infant who plays on the automobile toy will be given a real sense which resembles a practical automobile. The opposite sides of the driver's compartment are formed with openings 23 in which doors 24 are pivoted by means of upright pivot pins 24' (only one pin is shown) provided in the bottoms of the openings 23 for pivotal movement between the closed position and open position.

The mounting arrangement of the front and rear wheels will be now described in detail.

Figure 6:
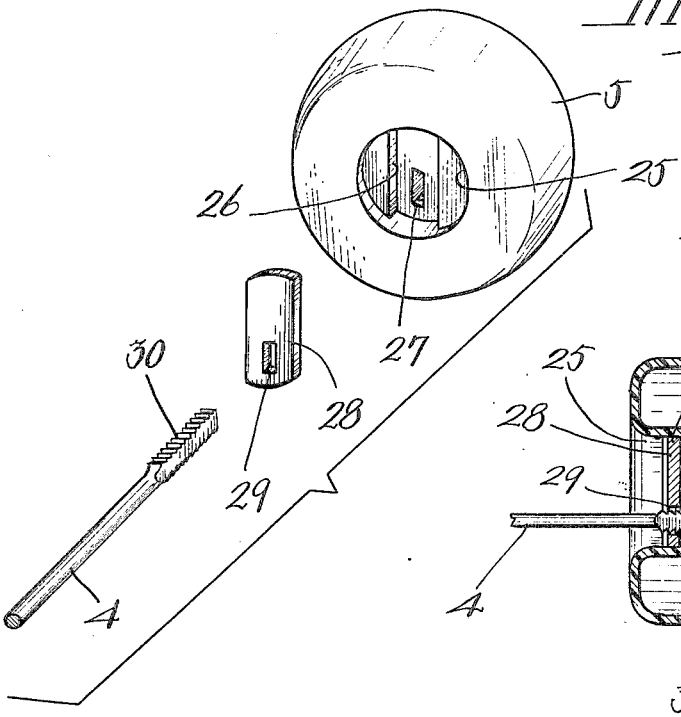
FIG. 6 is a fragmentary exploded perspective view of said rear wheel and its mounting arrangement of FIG. 5.
Figure 5:
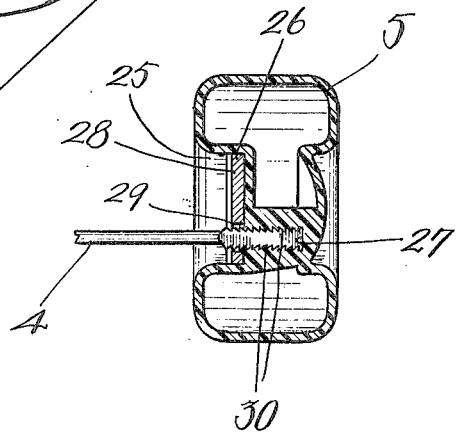
FIG. 5 is a fragmentary sectional view in side elevation of the rear wheel and its mounting arrangement.
Figure 7A:
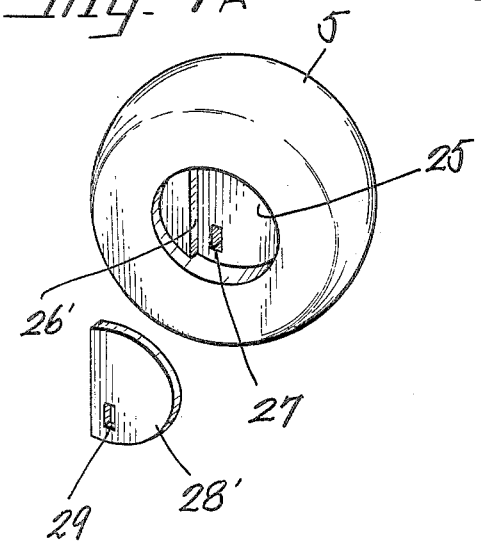
FIG. 7A is a fragmentary exploded perspective view of said rear wheel and its first modified mounting arrangement.
Figure 7B:
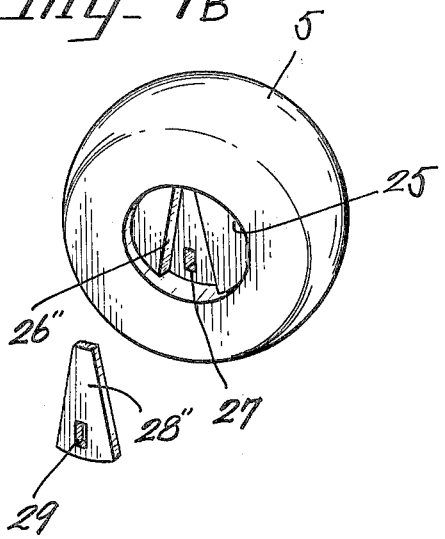
FIG. 7B is a fragmentary exploded perspective view of said rear wheel and its second modified mounting arrangement.
Figure 9A:
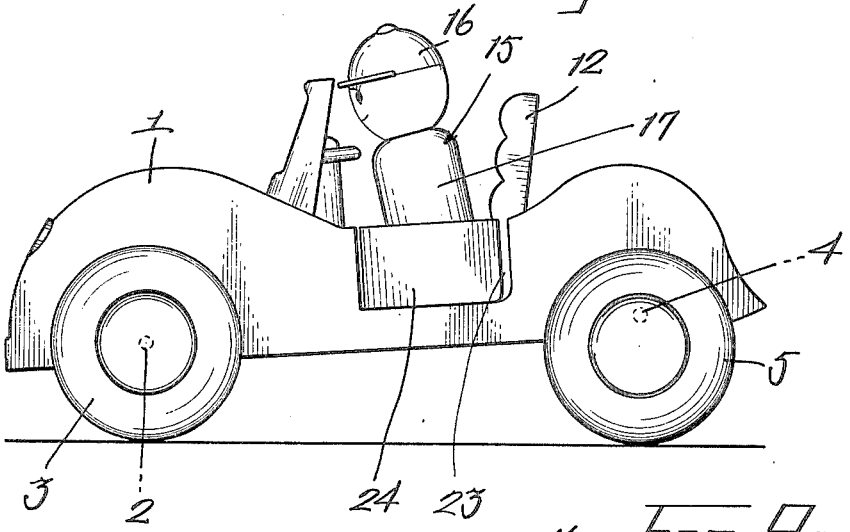
FIGS. 9A and 9B are views showing the rocking movement of a doll in the form of a driver figure as the automobile toy body moves along a support floor or ground.
Figure 9B:
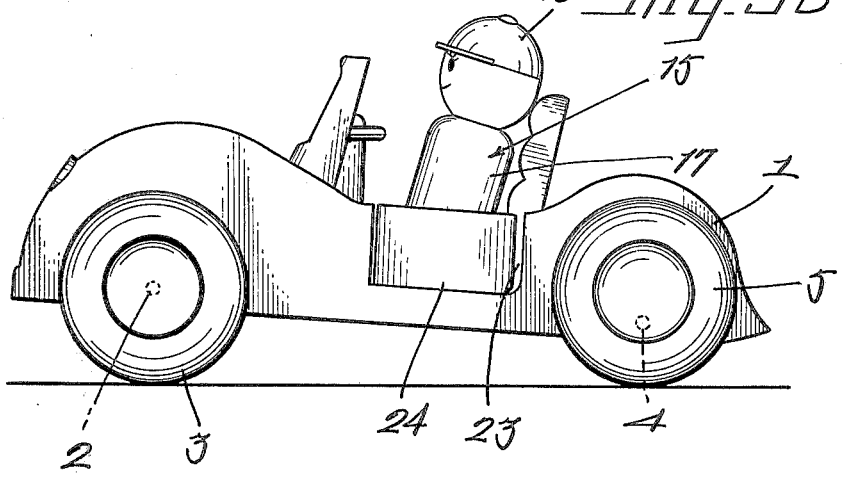

Referring to FIGS. 5 and 6 in which the mounting arrangement of one rear wheel 5 is shown. The rear wheel 5 is formed in the inner surface with a center hole 25 having a diametrically extending rectangular recess 26 in the bottom which is in turn formed with an eccentric rectangular groove 27 extending at right angles to the hole 25 and recess 26. An insert piece 28 having a shape corresponding to the rectangular recess 26 and a through hole 29 which communicates with the groove 27 is received in the recess 26. Each of the extreme outer ends of the rear wheel axle 4 is flattened and provided on the upper and lower surfaces with teeth 30 to be received in the associated groove 27. The shape of the recess 26 and insert piece 28 may be varied within a wide range departing from the scope of the present invention. FIG. 7A shows a semi-circular recess 26' and a semi-circular insert piece 28' and FIG. 7B shows a sector-shaped recess 26'' and a sector-shaped insert piece 28''. The modified rear wheel arrangements of FIGS. 7A and 7B are substantially the same as those as described in the rear wheel arrangement of FIGS. 5 and 6 with respect to the parts except for the recess and insert piece.

The shape of the recess and insert piece may be selected within a wide varying range provided the shape is non-circular.

Figure 8A:
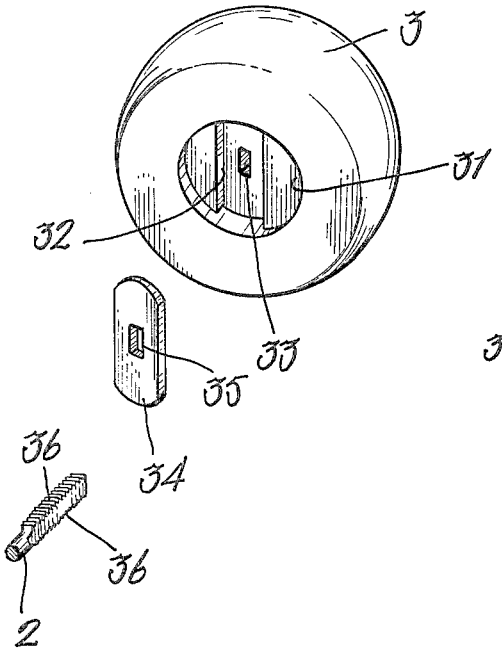
FIG. 8A is a fragmentary exploded perspective view of the front wheel and its mounting arrangement.

FIG. 8A shows a first embodiment of front wheel mounting arrangement. The front wheel 3 has a center hole 31 in the inner surface and a rectangular recess 32 extends diametrically across the bottom of the hole 31 and is provided in the center of the recess with a groove 33 extending at right angles to the hole 31 and recess 32. An insert piece 34 having a shape corresponding to that of the recess 32 and a through hole 34 which communicates with the groove 33 is received in the recess 32.

Each of the extreme opposite ends of the front wheel axle 2 is flattened and provided on the upper and lower surfaces with teeth 36 to be received in the groove 33.

Figure 2:
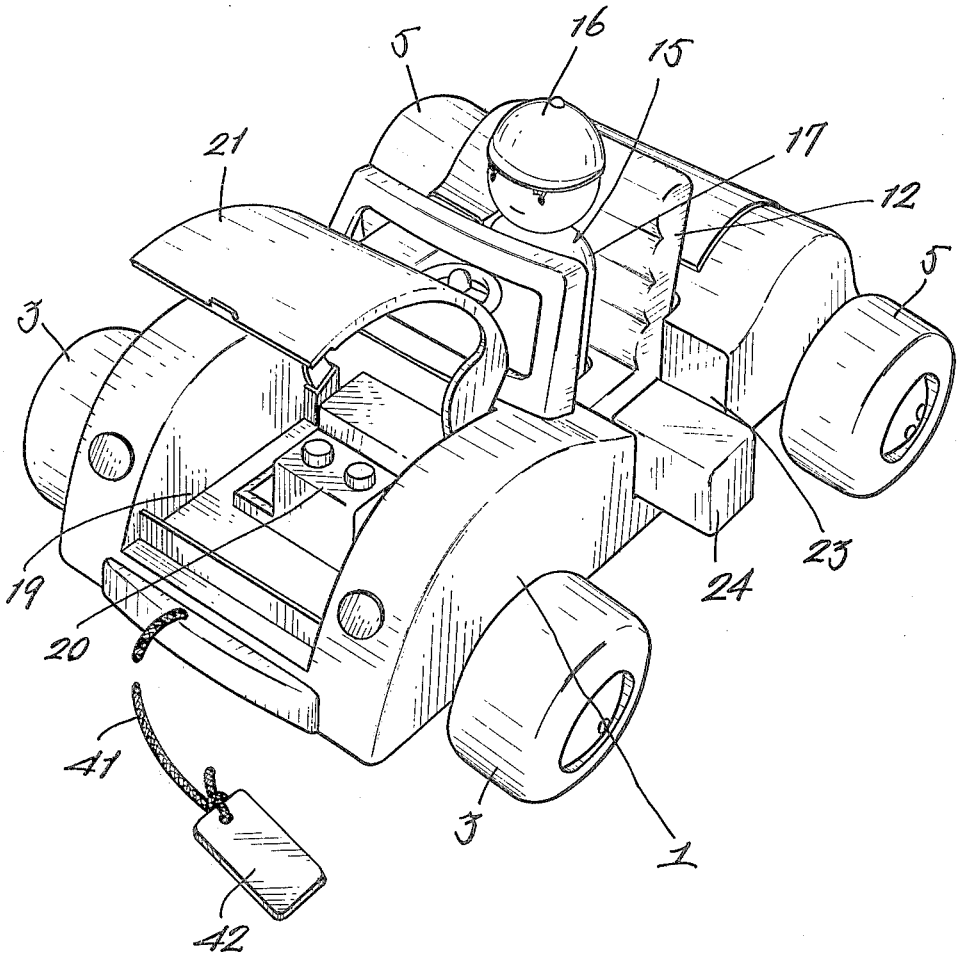
FIG. 2 is similar to FIG. 1, but shows the toy with the front cover and the driver's compartment door held in their open position.
Figure 3:
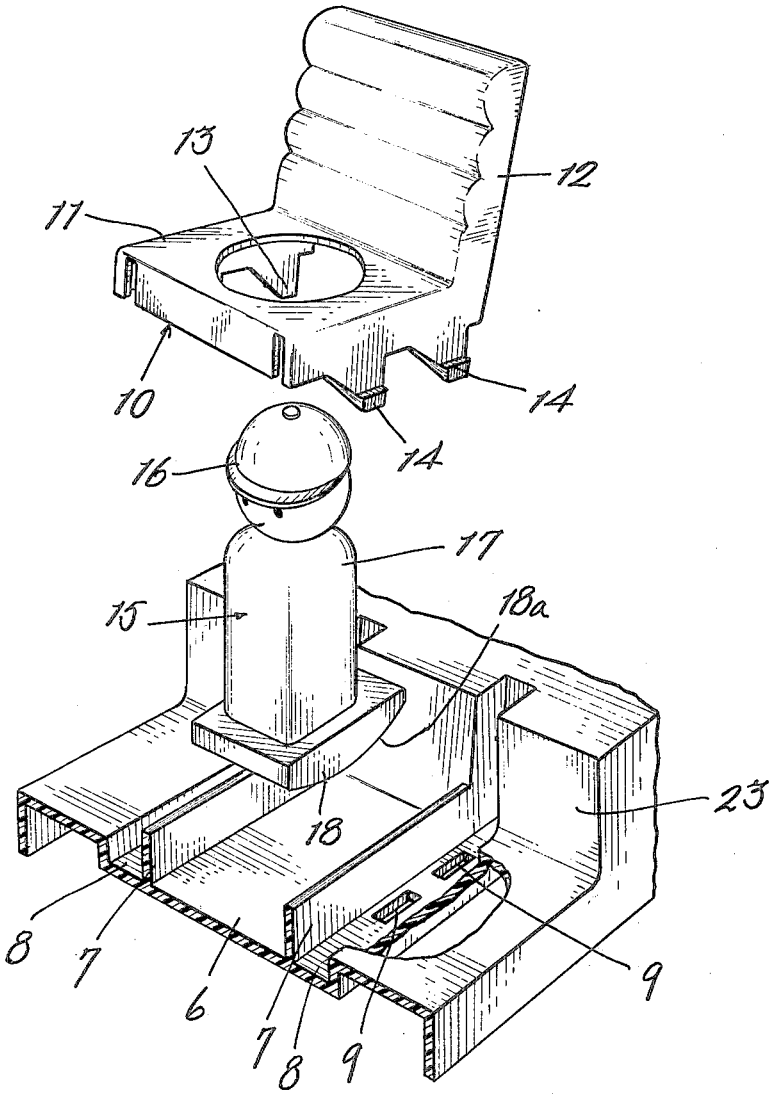
FIG. 3 is a fragmentary exploded perspective view of the parts associated with the driver's compartment.
Figure 4:
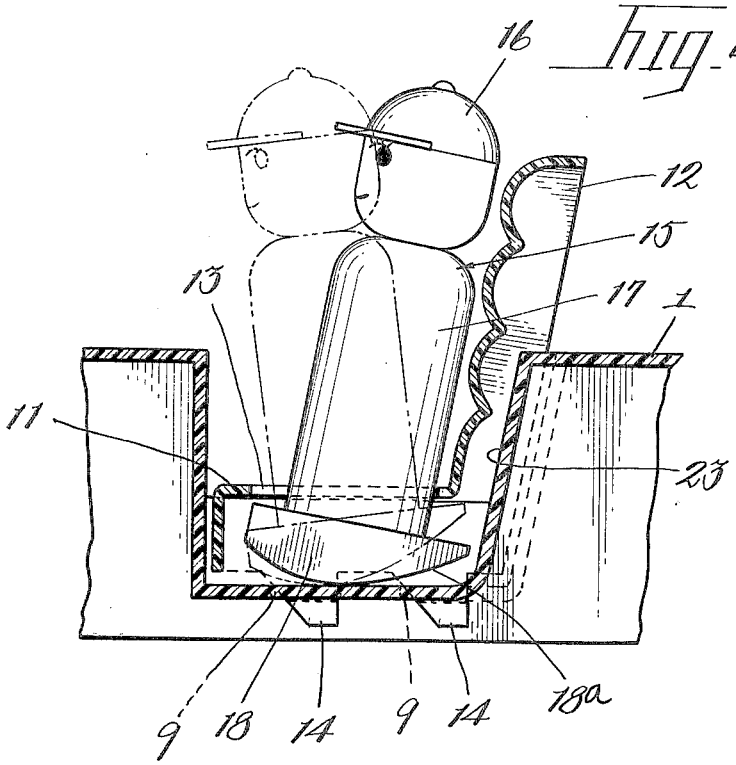
FIG. 4 is a fragmentary side elevational view of the parts associated with the driver's compartment in the assembled condition.
Figure 10:
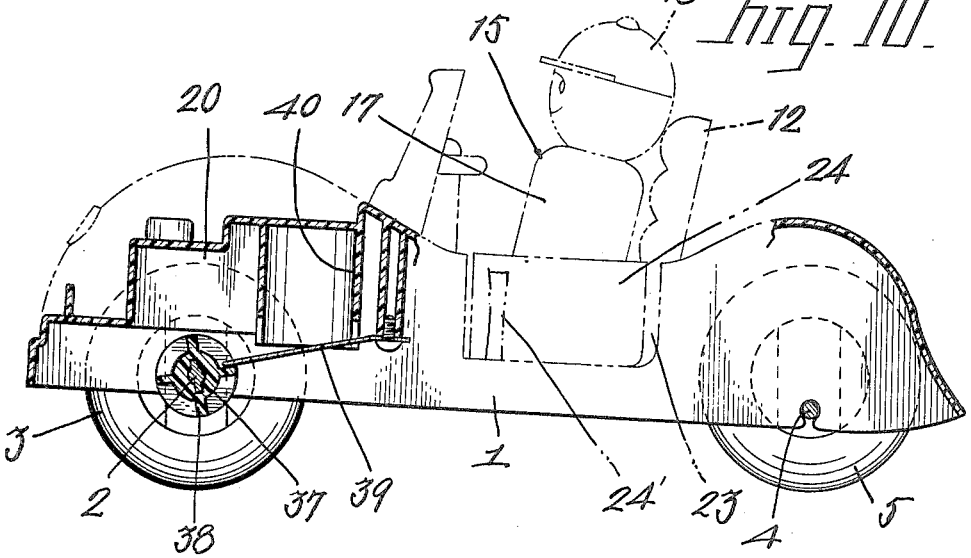
FIG. 10 is a longitudinal sectional view in side elevation showing the sound producing mechanism of the automobile toy.

The front wheel axle 2 further supports a sound producing wheel 37 (see FIG. 10) adjacent and inwardly of one of the teethed extreme ends and the sound producing wheel had a plurality of ribs 28 adapted to in turn be engaged by a resilient metal metallic engaging piece 39 the other end of which is attached to a sound propagation member 40 which is suitably mounted within the front portion of the body 1. Thus, when the ribs 38 of the sound producing wheel 37 are in turn engaged by the resilient engaging piece 39 as the automobile toy is moved along a support floor or ground, a simulated engine sound is intermittently produced and the produced sound is propagated by means of the sound propagation member 40. In FIGS. 1 and 2, references numerals 41 and 42 denote a tow string attached to the front end of the body 1 and a grip attached to the string, respectively.

Figure 8B:
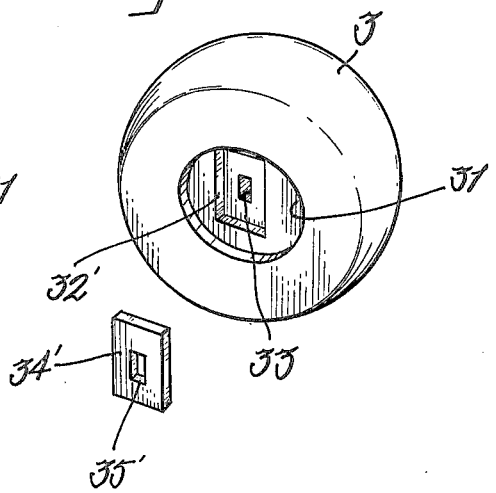
FIG. 8B is a fragmentary exploded perspective view of said front wheel and its modified mounting arrangement.

FIG. 8B shows a modified front wheel mounting arrangement which is substantially similar to the mounting arrangement of FIG. 8A except for the shape of the recess formed in the front wheel and insert piece to be fitted in the recess. In FIG. 8B, the recess 32' has a a rectangular shape similar to the recess 32 in FIG. 8A, but does not extend across the entire diameter of the hole 31 with the opposite ends terminating short of the periphery of the circular hole 31. Similarly, the insert piece 34' of FIG. 8B has a shape corresponding to that of the modified recess 32'.

With the above construction and arrangement of the parts of the automobile toy of the present invention, when the automobile toy is moved along the support floor or ground by means of the two string and grip assembly 41, 42, the body 1 moves upwardly and downwardly by virtue of the eccentrically mounted rear wheels 5, 5 and at the same time, the driver figure doll 15 rocks back and forth and a simulated engine sound is intermittently produced by the intermittent engagement between the sound producing wheel 37 and resilient piece 39. Furthermore, according to the present invention, the front cover 21 is pivotally mounted in the front portion of the body 1, the cover can be opened to uncover the simulated engine 21 formed on the front portion of the body and since the doors 24 are also pivotally mounted in the body 1, the doors can be opened or closed to thereby give a reality to the automobile toy so as to increase infants' interest in playing on the toy.

In the foregoing description has been made of only one embodiment of the invention, but it will readily occur to those skilled in the art that the same is illustrative in nature, but does not limit the scope of the invention in any way. The scope of the invention is only limited by the appended claims.

What is claimed is:

1. An automobile toy which comprises in combination a body, a front wheel axle extending across the front portion of said body and coaxially supporting front wheels at the extreme opposite ends, a rear wheel axle exending across the rear portion and eccentrically supporting rear wheels at the extreme opposite ends so as to move said body upwardly and downwardly as said rear wheels are rotated when the automobile toy is moved, said body defining a driver's compartment between said front and rear portions thereof, a driver figure doll loosely received in said driver's compartment for rocking movement back and forth as said body moves upwardly and downwardly, in which said front wheel axle supports a sound producing wheel adjacent and inwardly of the adjacent front wheel and said front portion of the body includes a resilient metallic engaging piece adapted to intermittently engage said sound producing wheel so as to produce a sound intermittently as said automobile toy is moved upwardly and downwardly.

2. An automobile toy which comprises in combination a body, a front wheel axle extending across the front portion of said body and coaxially supporting front wheels at the extreme opposite ends, a rear wheel axle extending across the rear portion and eccetrically supporting rear wheels at the extreme opposite ends so as to move said body upwardly and downwardly as said rear wheels are rotated when the automobile toy is moved, said body defining a driver's compartment between said front and rear portions thereof, a driver figure doll loosely received in said driver's compartment for rocking movement back and forth as said body moves upwardly and downwardly, comprising flattened teeth formed at each of the extreme opposite ends of each of said front and rear wheel axles, a groove formed in the inner surface of the associated wheel for receiving said flattened teeth, a non-circular recess formed in said inner surface of the wheel surrounding said groove and a metallic insert piece having a shape corresponding to that of said non-circular recess and received in the non-circular recess and having a through hole through which said flattened teeth extend.

3. An automobile toy which comprises in combination a body having an open front portion, a rear portion and a driver's compartment positioned between said front and rear portions, a front cover pivotally mounted in said front body portion and normally closing the front portion, said cover being pivotal between the closing and open positions, a transverse front wheel axle extending across said front body portion and coaxially supporting front wheels at the extreme opposite ends, a rear wheel axle extending across said rear body portion and eccentrically supporting rear wheels at the extreme opposite ends, a driver figure doll loosely received in said driver's compartment for rocking movement back and forth as said rear wheels rotate eccentrically, doors pivoted on the opposite sides of said driver's compartment, a simulated engine formed within said front portion of the body to be uncovered when said front cover is pivoted to its open position and a sound producing mechanism.

4. The automobile toy as set forth in claim 3, in which said driver's compartment further includes a seat member comprising a seat portion having a center opening and engaging projections at the bottom received in slots formed in said front body portion and an integral back rest portion and said driver figure doll comprises a head portion, a body trunk having a diameter smaller than the diameter of said center opening in the seat portion and a base portion having dimensions greater than the diameter of said seat portion.

5. The automobile toy as set forth in claim 3, in which said sound producing mechanism comprises a sound producing wheel mounted on said front wheel axle adjacent to and inwardly of the front wheel at one end of said axle and having a plurality of ribs and a metallic engaging piece adapted to intermittently engaging at one end said ribs on the sound producing wheel and secured at the other end to a sound propagation member mounted in said front body portion.

6. The automobile toy as set forth in claim 3, further including a front wheel mounting arrangement which includes a center hole formed in the inner surface of each of said front wheels, a non-circular recess extending across the bottom of said hole, a center groove extending at right angles to said hole and recess, a non-circular insert piece received in said recess and having a center hole in communication with said groove and teeth formed at each of said extreme opposite ends of the front wheel axle.

7. The automobile toy as set forth in claim 3, further including a rear wheel mounting arrangement which includes a center hole formed in the inner surface of each of said rear wheels, a non-circular recess extending across the bottom of said hole, an eccentric groove extending at right angles to said hole and recess, a non-circular insert piece received in said non-circular recess and having an eccentric hole in communication with said eccentric groove and teeth formed at each of said extreme opposite ends of the rear wheel axle.

* * * * *